United States Patent [19]

McVey

[11] 4,246,561

[45] Jan. 20, 1981

[54] TEMPERATURE-RESPONSIVE ELECTRICAL SWITCH WITH SLIDING CONTACT

[75] Inventor: John K. McVey, Bensenville, Ill.

[73] Assignee: Illinois Tool Works Inc., Chicago, Ill.

[21] Appl. No.: 60,527

[22] Filed: Jul. 25, 1979

[51] Int. Cl.[3] ..... H01H 37/76

[52] U.S. Cl. ..... 337/407; 337/409

[58] Field of Search ..... 337/407, 408, 409

[56] References Cited

U.S. PATENT DOCUMENTS

| | | | |
|---|---|---|---|
| 3,821,685 | 6/1974 | Kimball et al. | 337/409 |
| 4,065,741 | 12/1977 | Sakamoto et al. | 337/407 |
| 4,084,147 | 4/1978 | Mlyniec et al. | 337/409 |
| 4,126,845 | 11/1978 | Iimori et al. | 337/409 |

*Primary Examiner*—George Harris

*Attorney, Agent, or Firm*—Thomas L. Buckman; Glenn Bowen

[57] ABSTRACT

A temperature-responsive electrical switch is provided which has a pair of axial leads, one of which is connected to the cylindrically-shaped electrically conductive housing, and the other of which passes through an insulator into the interior of the housing. A cylindrical-shaped, slideable electrical contact which is open at one end is positioned in the housing. A coil spring is located inside the slideable contact between the bottom end of the contact and an enlarged section of the insulator. The contact has a plurality of spring fingers which are integrally formed from the bottom of the contact and which project upwardly from the bottom of the contact toward the head of the insulated lead. A thermally-sensitive pellet, which melts at a predetermined temperature and is formed to have a cavity in it, is positioned below the spring fingers. The pellet is dimensioned transversely so as to force the fingers into contact with the head of the insulated lead. Upon reaching the predetermined temperature the pellet melts and its liquid mass assumes a smaller transverse dimension, because of the original cavity in the solid pellet. This allows the spring to release its compressive force; and this, in turn, allows the slideable contact to move along the interior of the housing so as to thereby break electrical contact between the spring fingers and the head of the insulated lead.

4 Claims, 4 Drawing Figures

TEMPERATURE-RESPONSIVE ELECTRICAL SWITCH WITH SLIDING CONTACT

BACKGROUND OF THE INVENTION

Thermally-responsive electrical switches of the sliding contact-type are generally known. One type of such switch is shown in the Merrill U.S. Pat. No. 3,180,958, issued Apr. 27, 1965. In the switch of the Merrill patent, a pair of axial leads are used to connect the device into an electrical circuit. One of the axial leads is electrically connected to an electrically conductive, cylindrically-shaped housing and the other lead is positioned into the interior of the housing through an electrical insulator which electrically isolates it from the housing. A coil spring is positioned around a portion of the electrical insulator to make contact with a slideable contact member that engages the inner surface of the electrically conductive housing. A solid, thermally-sensitive pellet is positioned at the end of the housing which is connected to the uninsulated axial lead. A separating washer is positioned between the thermally-sensitive pellet and a second spring which is inserted between the washer and the sliding contact. The second spring acts to force the slideable contact against the head of the insulated lead to complete the electrical circuit from the outer electrically conductive housing through the insulated lead as long as this pellet remains solid. When the pellet melts, the coil spring forces the slideable contact away from the insulated lead thereby breaking electrical contact between the leads.

In the switch of the Merrill patent the washer against the pellet has a diameter which is less than the diameter of the pellet. This is a requirement of the Merrill switch since when the pellet melts the liquid mass of the pellet must flow around the washer and over the second bias spring in order to allow for the required movement of the slideable contact. This combination of an undersized washer and the second spring makes the assembly of the device somewhat more complicated than desirable, and the device of the Merrill patent is somewhat position-dependent since the flow of the melted mass of the pellet material around the separating washer will be in part dependent upon the force of gravity. The flow of the melted mass of the pellet of the Merrill patent, therefore, will vary somewhat according to the physical orientation of the device. The improved device of the present invention is easily assembled and almost completely position-independent since operation of the switch does not rely upon the pressure supplied by a separate secondary spring to force the melted mass of the pellet around itself and an undersized washer, as does the switch of the Merrill patent. Moreover, the device of the present invention is anticipated to be cheaper to make and of a higher reliability.

Another reason for the anticipated cost savings and increased reliability is that in the device of the present invention the spring forces of the coil spring and the spring fingers that are integrally formed from the sliding contact member are independent of one another. In the Merrill patent there is a space between the pellet and the head of the insulated lead, and the design therefore requires that two springs be used, but one spring must have a stronger force constant than the other since the stronger spring must overcome the secured spring to maintain electrical contact. In the device of the present invention, by contrast, the pellet itself, either alone, or in conjunction, with a separating washer, directly acts on the spring fingers to hold them in contact with the head of the insulated lead; and thus the spring force of the spring fingers does not have to overcome the spring force of the coil spring.

DESCRIPTION OF THE DRAWINGS

The present invention is described by reference to the following drawings in which.

TECHNICAL DESCRIPTION OF THE INVENTION

Figure 1:
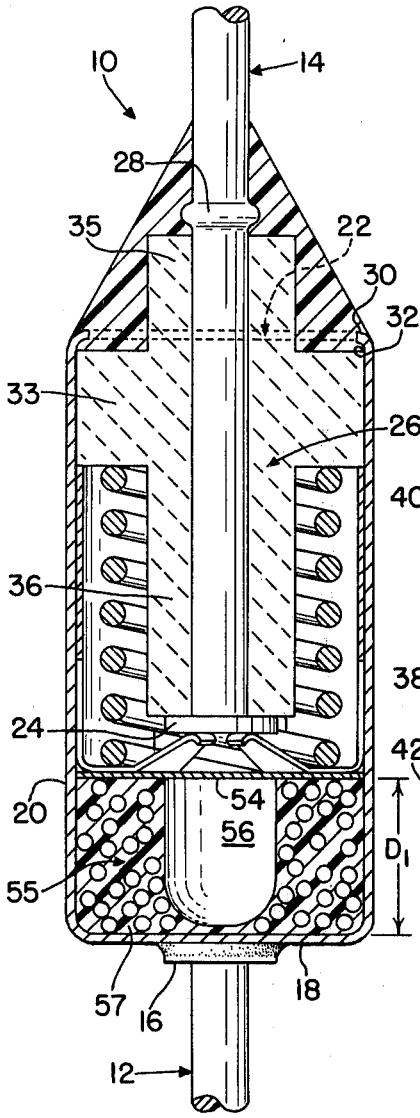
FIG. 1 is a cross-sectional view of the switch with the pellet in solid form.

The thermally-responsive electrical switch 10 of the present invention is constructed to have a pair of axial leads 12, 14, which are connected to the circuit to be protected. The lead 14 has a head 16 on it which contacts the bottom outer surface 18 of an electrically-conductive, cylindrically-shaped housing 20. The housing 20 is open at its top end 22 and the lead 14, which also has a head 24, extends well into the interior of the housing through the open end 22. An electrical insulator 26 receives the lead 14 through a central bore that extends through the insulator. An increased diameter ring 28 is formed on the top end around the upper portion of the lead 14 so that the insulator is held between the head 24 and the ring 28. The insulator 26 is positioned in the housing 20 through the open end 22, and the rim 30 of the housing 20 is bent over the edge 32 of the insulator 26 to secure the housing thereto. Epoxy, or other type of suitable sealing material 34 is then provided to cover the ring 28 and the top portion 35 of the insulator 28, as well as the bent-over rim 30.

Figure 3:
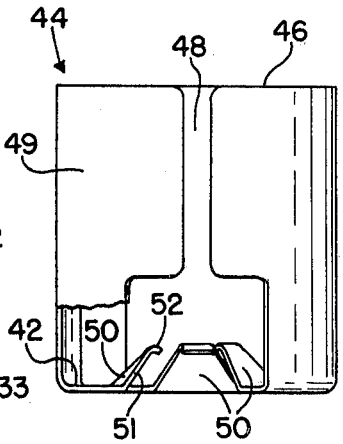
FIG. 3 is a side view of the sliding contact of the switch which is broken away along the lines 3—3 of FIG. 4 to show the contact fingers.
Figure 4:
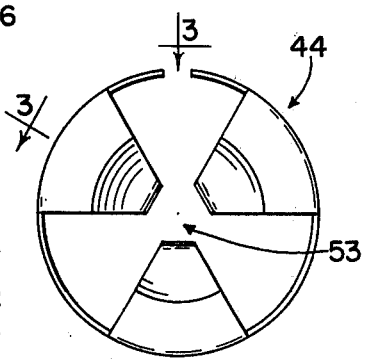
FIG. 4 is a top view of the sliding contact of FIG. 3.

The lowermost portion 36 of the insulator 26 is surrounded by a coil spring 38, which is under compression when the device is assembled, as shown in FIG. 1. The spring 38 is placed between the lower coil 40 of the enlarged section 33 of the insulator 26 and the bottom coil 42 of a sliding electrical contact 44 which is positioned inside of the housing 20. The electrical contact 44 is formed, as shown best in FIG. 3, to have a generally cylindrical-shape with an open top 46 and a slot 48 that runs through the sidewall 49. A plurality of spring fingers are integrally formed from the bottom coil 42 of the contact 44. These fingers 50 project upwardly over an angled portion 51 to a bent-over contact portion 52 which forms a curved contact against the head 24 of the lead 14. The contact 44 of the illustrated embodiment is shown with three contact fingers, although any number of fingers that are practical may be employed, as desired. The use of multiple fingers, however, increases the reliability of the device since it increases the number of contact points.

A separating washer 54, preferably made of an electrically-insulating material, is desirably employed in the device between the fingers 50 and a solid thermally-sensitive pellet 55. The washer may be of mica, or other suitable insulating material. It is to be noted, however, that the mica insulator may, or may not, extend across the entire dimension of the housing of the present invention. The size of the washer is not important since the electrical contact itself is shaped so as to substantially extend across the entire inner diameter of the housing 20. As long as the gap 53 through the fingers is blocked off by the washer 54, no melted pellet material will flow when the thermal pellet melts. Therefore, when the washer 54 is used the switch of the present invention does not need to rely upon the flow of material up around the coils of the spring 38, thus, minimizing any gravitational force effect upon the orientation of the device.

Figure 2:
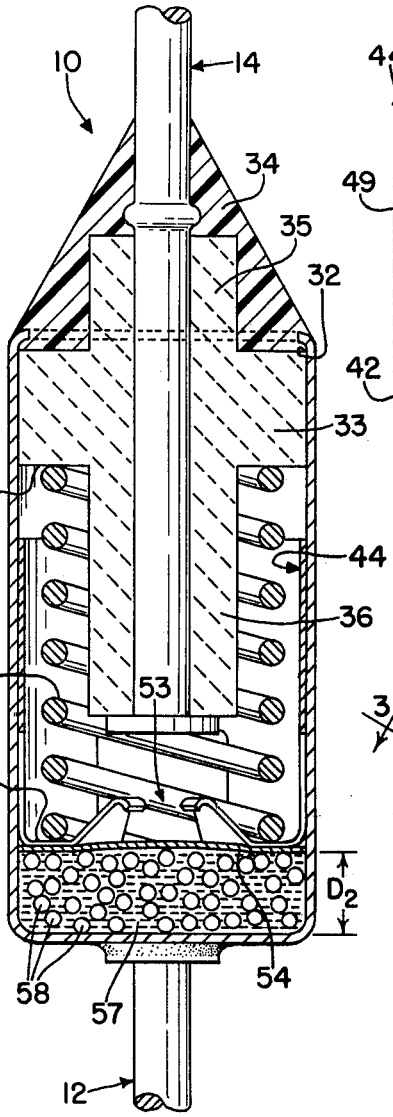
FIG. 2 is a cross-sectional view of the switch after the pellet has melted and electrical connection has been broken between the axial leads of the switch.

The thermally-sensitive pellet 55 is formed to have a cavity 56 in it which is preferably centrally located. Thus, when the pellet 55 melts and assumes a liquid form, as shown in FIG. 2, it will assume a smaller transverse dimension, $D_2$, than its transverse dimension, $D_1$ when it is in solid form, as shown in FIG. 1. This allows the compressed spring 28 to expand, which, in turn, forces the sliding contact 44 away from the head 24 of the lead 14, thereby breaking electrical connection between the fingers 50 and the head 24 and, thus, also between the leads 12, 14. The pocket, or cavity formed in the pellet 55 may run all of the way through the pellet and the pellet may be shaped as a ring, if desired; and it would work equally as well, depending upon the dimensions of the pocket, or cavity.

The thermally-sensitive pellet 55 is shown in the drawings as being formed of a unified mixture of an organic material 57 which is solid in FIG. 1 and molten in FIG. 2, and a multitude of spherical glass beads 58. The organic material 57 surrounds the multitude of glass beads 58 and holds them together in a unified mass when the pellet 55 is solid. This mixture of glass beads and organic material has a high volume of glass beads relative to the volume occupied by the organic material which provides a temperature-sensing pellet that has a greatly increased strength over that of conventional pressed pellets. It is not essential that such a unified glass bead, organic mixture be employed in the thermal-sensing pellet of the present invention; however, it is preferable to do so because of the increased strength of such a combination. The combination of the unified mixture of glass beads and organic material is described in more detail in co-pending U.S. patent application Ser. No. 940,418, filed Sept. 7, 1978 in the names of John McVey and Bruce Luxon, which application is assigned to the assignee of the present invention, and the disclosure of this application is thereby incorporated-by-reference into the present application.

What is claimed is:

1. A temperature-responsive switch comprising a cylindrically-shaped electrically conductive housing, a first conductor insulated from said housing and passing into said housing and having a fixed contact thereon which is located in said housing, a cylindrically-shaped sliding contact that has a conductive wall in contact with a substantial length of the interior of said housing and that has a plurality of spring finger contact means integrally formed thereon, a collapsible thermal pellet having a cavity therein and a coiled spring bias means for forcing said sliding contact away from said fixed contact and toward said pellet, said spring finger contact means on said sliding contact and said fixed contact being in contact with each other when said pellet is solid and being forced out of contact with each other when said pellet melts at a predetermined temperature so that said cylindrically-shaped sliding contact slides along, in contact with, the interior of said housing causing said spring finger contact means to move into a portion of said housing that was previously occupied by said solid pellet under the action of said coiled spring bias means due to the resulting decrease in volume of said housing that is occupied by the material comprising said pellet when it melts.

2. A temperature-responsive switch as claimed in claim 1 further comprising an insulating washer that extends across a substantial portion of said housing between said pellet and said sliding contact.

3. A temperature-responsive switch as claimed in claim 1 wherein said conductive wall of said sliding contact is slotted along its entire length.

4. A temperature-responsive switch as claimed in claim 3 further comprising an insulating washer that extends across a substantial portion of said housing between said pellet and said sliding contact.

* * * * *